United States Patent [19]

Bares

[11] Patent Number: 4,571,060

[45] Date of Patent: Feb. 18, 1986

[54] HOUSING SEAL

[75] Inventor: Jan Bares, Webster, N.Y.

[73] Assignee: Xerox Corporation, Stamford, Conn.

[21] Appl. No.: 663,270

[22] Filed: Oct. 22, 1984

[51] Int. Cl.[4] ..... G03G 15/08

[52] U.S. Cl. ..... 355/3 DD; 355/15; 355/14 D; 430/120; 430/136; 118/641; 428/913

[58] Field of Search ..... 355/3 DD, 14 D, 3 FU, 355/14 FU, 3 DR, 15; 430/34, 120, 129, 130, 136; 118/628, 641; 428/500, 908, 913

[56] References Cited

U.S. PATENT DOCUMENTS

| | | | |
|---|---|---|---|
| 3,635,196 | 1/1972 | Tsilibes | 118/653 X |
| 3,809,012 | 5/1974 | Delvecchio | 118/653 X |
| 3,872,826 | 3/1975 | Hanson | 118/653 X |
| 3,872,828 | 3/1975 | Hartwig et al. | 118/653 X |
| 3,883,921 | 5/1975 | Thettu et al. | 15/256.52 |
| 3,906,899 | 9/1975 | Harpavat | 118/653 X |
| 4,127,083 | 11/1978 | Sesoko | 118/653 X |
| 4,168,901 | 9/1979 | Ito et al. | 355/3 DD |
| 4,304,192 | 12/1981 | Mayer | 118/653 |
| 4,459,009 | 7/1984 | Hays et al. | 355/3 DD |

*Primary Examiner*—A. C. Prescott

*Attorney, Agent, or Firm*—H. Fleischer; J. E. Beck; R. Zibelli

[57] ABSTRACT

An apparatus which seals a housing to prevent the escape of toner particles therefrom. The toner particles are captured and softened to become tacky. Additional toner particles stick to the tacky toner particles preventing their escape. Each successive layer of captured toner particles soften and become tacky capturing other toner particles thereto.

46 Claims, 5 Drawing Figures

HOUSING SEAL

This invention relates generally to an electrophotographic printing machine, and more particularly concerns an apparatus for sealing a housing to prevent the escape of toner particles therefrom.

Generally, the process of electrophotographic printing includes charging a photoconductive member to a substantially uniform potential so as to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently affix it to the copy sheet in image configuration. A suitable developer material may be made from a single component material, such as toner particles. These toner particles are dispensed from a toner dispenser into a developer housing and brought into contact with the electrostatic latent image recorded on the photoconductive surface. The toner particles are attracted to the latent image forming a toner powder image thereon. Residual toner particles are cleaned from the photoconductive member after transfer of the powder image to the copy sheet. A cleaning housing includes a chamber for storing the particles removed from the photoconductive surface.

For both the developing housing and cleaning housing, it is desirable to prevent the escape of particles stored in the chambers thereof. Any particles escaping from these chambers may contaminate the various processing stations within the printing machine possibly resulting in degradation of copy quality. The problem of particle escape and machine contamination is a long standing one in electrophotographic printing. Various approaches have heretofore been devised for containing particles within a housing. The following disclosures appear to be relevant:

- U.S. Pat. No. 3,809,102; Patentee: Delvecchio; Issued: May 7, 1974.
- U.S. Pat. No. 3,872,826; Patentee: Hanson; Issued: Mar. 25, 1975.
- U.S. Pat. No. 3,883,921; Patentee: Thettu et al.; Issued: May 20, 1975.
- U.S. Pat. No. 3,906,899; Patentee: Harpavat; Issued: Sept. 23, 1975.
- U.S. Pat. No. 4,304,192; Patentee: Mayer; Issued: Dec. 8, 1981.

The relevant portions of the foregoing disclosures may be briefly summarized as follows:

Delvecchio describes a developer housing having a side or end seal comprising a multiplicity of overlapping resilient deflector vanes projecting in the direction of movement of the photoconductive drum. The vanes deflect the carrier beads of the developer material inwardly away from the edges of the seal. This reduces developer material leakage under the seals. The seals are made from rubber and extend about the drum periphery in continuous engagement therewith.

Hanson discloses a developer housing including a top seal and end seals. The end seals are located on either side of the developer housing in the development zone. Each end seal is a strip of polymethyl foam secured to the developer housing with the free end in contact with the photoconductive drum. The top seal is a brush secured to the top of the developer housing with the free end of the brush contacting the photoconductive drum.

Thettu et al. discloses a web of a polyester polymer wrapped about a roll. The web contacts a heated fuser roll and the polyester material becomes tacky removing toner particles and other contaminants from the fuser roll.

Harpavat describes a magnetic seal for a developer housing. The magnet attracts magnetic particles to form a seal between the developer housing and the photoconductive drum.

Mayer discloses a thin strip of resilient material secured, in cantilever fashion, to the lip of developer housing and extending to the developer roller. The strip provides a flexible closure which flexs to permit carrier granules to return to the reservoir while containing dust therein.

In accordance with one aspect of the features of the present invention, there is provided an apparatus for sealing a housing to prevent the escape of toner particles therefrom. A region of the housing is adapted to be sealed. Means, disposed on the region, capture the toner particles. The capturing means secures the toner particles and induces the toner particles to soften and become tacky so that other toner particles stick to the tacky toner particles.

Pursuant to another aspect of the features of the present invention, there is provided an apparatus of the type having means for depositing toner particles on an electrostatic latent image recorded on a photoconductive member in an electrophotographic printing machine. The improved apparatus includes an enclosure having the depositing means disposed therein. Means, disposed in the enclosure, capture the toner particles. The capturing means secures the toner particles and induces the toner particles to soften and become tacky so that other toner particles stick to the tacky toner particles.

In still another aspect of the features of the present invention, there is provided a method of preventing the escape of toner particles from a housing. The method includes the steps of adhesively securing toner particles to a crosslinked polymer matrix having a plasticizer therein. The plasticizer diffuses into the toner particles adhesively secured to the polymer matrix to induce the toner particles to soften and become tacky so that other toner particles are secured to the tacky toner particles.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
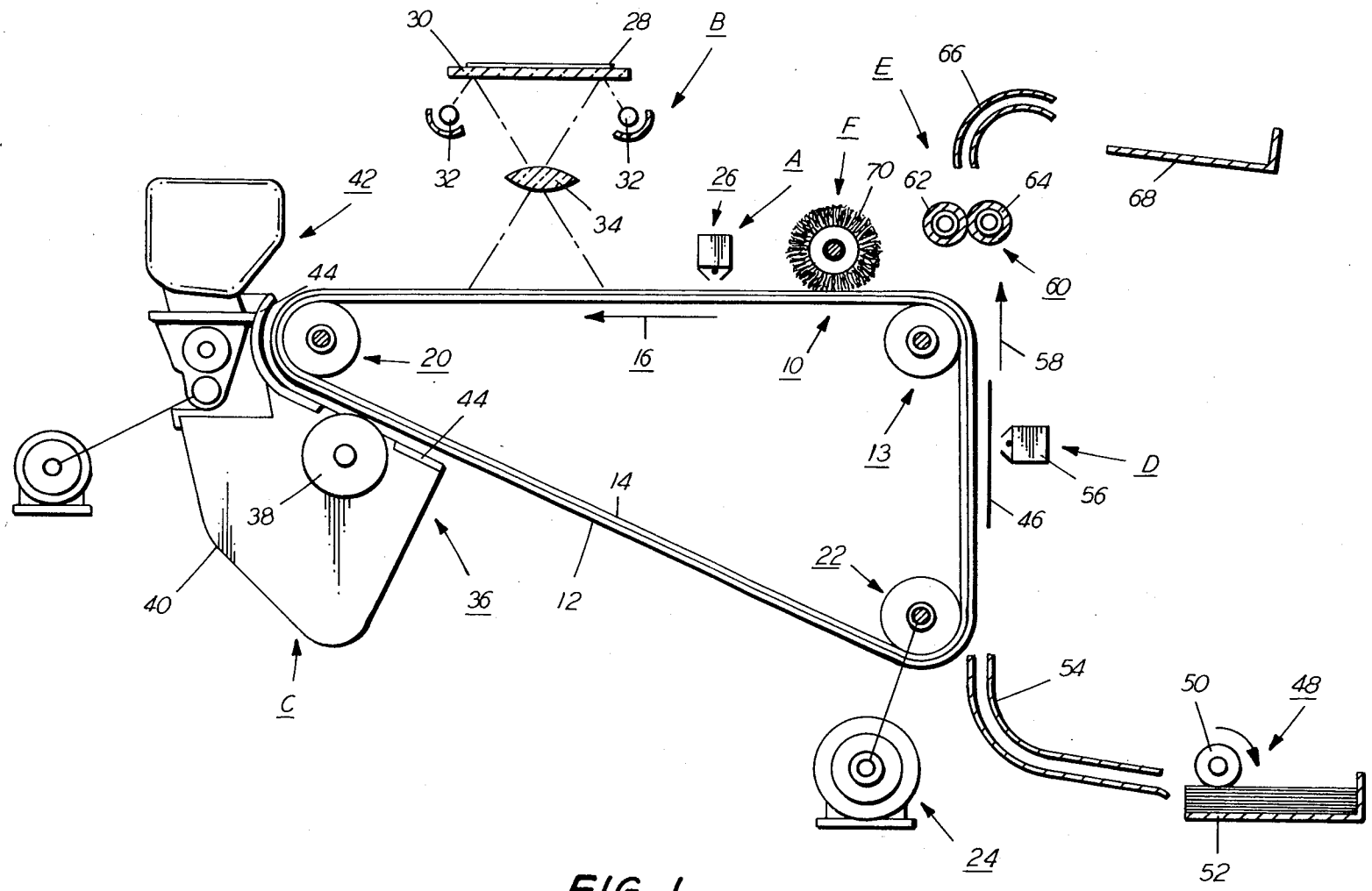
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the sealing apparatus of the present invention therein. It will become apparent from the following discussion that this apparatus is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically with their operation being described briefly with reference thereto.

Inasmuch as the development system of an electrophotographic printing machine stores a supply of toner particles, it is necessary to insure that this material is not readily dispersed throughtout the printing machine. It should also be noted that the cleaning system may also store toner particles therein. Thus, the sealing apparatus of the present invention, which will be described hereinafter with reference to an illustrative development system, may also be employed in such a cleaning system.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy, which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tension roller 20 and drive roller 22. Drive roller 22 is mounted rotatably and in engagement with belt 10. Motor 24 rotates drive roller 22 to advance belt 10 in the direction of arrow 16. Roller 22 is coupled to motor 24 by suitable means such as a drive belt.

Initially, a portion of belt 10 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through exposure station B. At exposure station B, an original document 28 is positioned face down upon a transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 corresponding to the informational areas contained within original document 28.

After the electrostatic latent image is recorded on photoconductive surface 12, belt 10 advances the latent image to development station C. At development station C, a magnetic brush development system, indicated generally by the reference numeral 36, advances the developer material into contact with the electrostatic latent image. Preferably, magnetic brush development system 36 includes a developer roller 38 disposed in housing 40. The developer roller advances the developer material into contact with the latent image. The latent image attracts the toner particles forming a toner powder image on photoconductive surface 12. As successive electrostatic latent images are developed, toner particles are depleted from housing 40. A toner particle dispenser, indicated generally by the reference numeral 42, furnishes additional toner particles to housing 40 of development system 36. Seals, indicated generally by the reference numeral 44, capture toner particles exiting developer housing 40. The detailed structure of seals 44 will be described hereinafter with reference to FIGS. 2 through 5, inclusive.

With continued reference to FIG. 1, after the electrostatic latent image is developed with toner particles, belt 10 advances the toner powder image to transfer station D. At transfer station D, a sheet of support material 46 is moved into contact with the toner powder image. The sheet of support material is advanced to transfer station D by a sheet feeding apparatus 48. Preferably, sheet feeding apparatus 48 includes a feed roll 50 contacting the uppermost sheet of stack 52. Feed roll 50 rotates so as to advance the uppermost sheet from stack 52 into chute 54. Chute 54 directs the advancing sheet of support material into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor (not shown) which advances the sheet to fusing station E.

Fusing station E includes a fuser assembly, indicated generally by the reference numeral 60 which permanently affixes the transferred image to sheet 46. Preferably, fuser assembly 60 comprises a heated fuser roller 62 and a back-up roller 64. Sheet 46 passes between fuser roller 62 and back-up roller 64 with the toner powder image contacting fuser roller 62. In this manner, the toner powder image is permanently affixed to sheet 46. After fusing, chute 66 directs the advancing sheet 46 to catch tray 68 for subsequent removal from the printing machine by the operator.

After the sheet of support material is separated from photoconductive surface 12 of belt 10, the residual toner particles are removed therefrom at cleaning station F. Cleaning station F includes a rotatably mounted fiberous brush 70 in contact with photoconductive surface 12. The particles are cleaned from photoconductive surface 12 by the rotation of brush 70 in contact therewith. The particles cleaned from photoconductive surface 12 by brush 70 are removed therefrom and stored in the chamber of a housing (not shown). The cleaning housing also includes seals substantially identical to seals 44 of developer housing 40.

Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
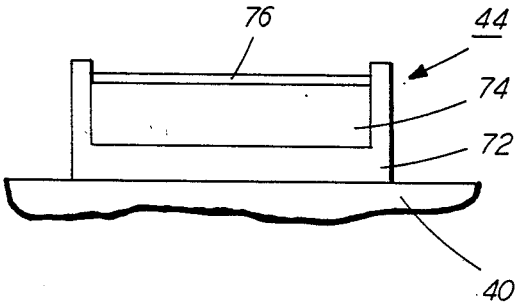
FIG. 2 is a sectional elevational view showing the apparatus for capturing toner particles.

Referring now to FIG. 2, there is shown an elevational view of sealing apparatus 44. As shown thereat, a tray 72 is mounted on developer housing 40. A polymer matrix base 74 is disposed in tray 72. Base 74 is a crosslinked polymer slab containing a non-volatile, low vapor pressure plasticizer capable of dissolving or at least making the toner particles tacky. A thin layer of adhesive 76 is coated on top of base 74 to adhesively secure toner particles thereto. Tray 72 is selected from a material which is resistant to the plasticizer diffused in base 74. Base 74 may be made from a polyvinychloride, crosslinked polymethyl methacrylate, or a crosslinked polystyrene and their copolymers swollen or actually polymerized in the presence of the plasticizer or other crosslinked materials. The foregoing are merely examples of the type of base materials which may be employed and any other suitable base material may also be used. Examples of non-volatile plasticizers diffused into base 74 are methyl phthalyl ethyl glycolate, butyl phthalyl ethyl glycolate, butyl benzyl phthalate, n-octyl-n-decyl phthalate, di octyl phthalate, di butoxy ethyl adipate, amongst others, or a mixture thereof. An exemplary adhesive 76 may be an adhesive tape including, for example acrylate or elastomer based adhesives. Preferably, the adhesive and/or base includes an additive to make it electrically conductive. The adhesive or base may be electrically biased to a suitable voltage by a voltage source connected thereto, or electrically grounded. A suitable additive is quaternary ammonium salts, such as tetrahepthyl ammonium bromide, hexadecyl trimethyl ammonium stearate, or polyelectrolytes. The adhesive layer is preferably of the thickness of about 0.001 inches. Base 74 is preferably of a thickness ranging from about 0.020 inches to about 0.040 inches. The adhesive is electrically conductive to make it more effective in collecting charged toner particles from a toner powder cloud. An electrical ground is connected to the adhesive. The plasticizer is approximately 50% by weight of the base material. In operation, the toner particles will initially adhere to adhesive layer 76. The plasticizer in base 74 diffuses into the toner particles softening and fusing the toner particles to adhesive layer 76. As the toner particles soften, they become tacky and additional toner particles stick or adhere thereto. These additional toner particles subsequently absorb the plasticizer and, in turn, soften and fuse to the layer of toner particles therebeneath. Now, these additional toner particles become tacky and additional toner particles stick thereto. The foregoing process continues until plasticizer within the base 74 is depleted to less than 25% thereof by weight. The foregoing process will be described in greater detail with reference to FIGS. 3 through 5, inclusive.

Figure 3:
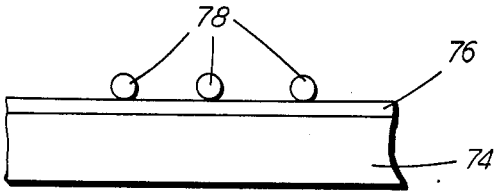
FIG. 3 is a fragmentary, sectional elevational view showing the FIG. 2 apparatus with toner particles secured thereto.

Turning now to FIG. 3, there is shown a fragmentary, sectional elevational view wherein toner particles 78 are adhesively secured to adhesive layer 76. As depicted thereat, adhesive layer 76 is coated or positioned on base 74. Airborne or freely floating toner particles land on adhesive layer 76 and are captured thereon. Thus, adhesive layer 76 serves as an initial capturing layer. The plasticizer within base 74 now diffuses into toner particles 78. As plasticizer diffuses therein, the toner particles soften. The foregoing is shown more clearly in FIG. 4.

Figure 4:
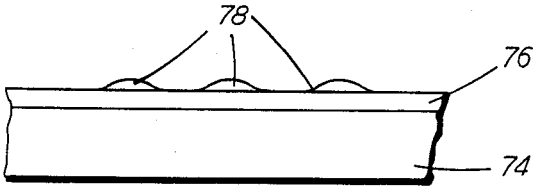
FIG. 4 is a fragmentary, sectional elevational view showing the FIG. 2 apparatus with toner particles thereon being softened and becoming tacky.

Turning now to FIG. 4, there is shown the plasticizer from base 74 diffusing through adhesive 76 into toner particles 78. As the plasticizer diffuses into toner particles 78 the toner particles soften and swell. These toner particles gradually become tacky, thus becoming an adhesive themselves. It has been found that the toner particles soften and fuse within about 30 seconds after capture on adhesive layer 76. The foregoing is shown more clearly in FIG. 5.

Figure 5:
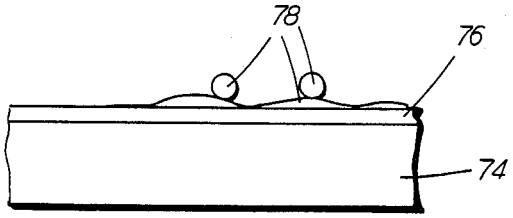
FIG. 5 is a fragmentary, sectional elevational view of the FIG. 2 apparatus showing a layer of softened, tacky toner particles having other toner particles secured thereto.

Referring now to FIG. 5, there is shown toner particles 78 completely softened and fused. These toner particles are now tacky. As depicted thereat, after the first layer of toner particles has softened and fused, it becomes tacky and additional toner particles are adhesively secured thereto. These additional particles now absorb the plasticizer from base 74 and, in turn, soften, fuse and become tacky. The foregoing process continues until the quantity of plasticizer remaining within base 74 is depleted beneath a critical level, i.e. approximately 25% by weight of the base material. In an experimental capture test, toner particles were piled on a slab of base material and the pile of toner particles blown thereoff after specified periods of time have lapsed. The slab was weighed with the captured material thereon and prior to the start of the test. After approximately 15 minutes, it was found that 2.23 milligrams/centimeter$^2$ of toner particles adhered to the slab. After approximately 65 hours, it was found that 27 milligrams/centimeter$^2$ of toner particles adhered to the slab. In both cases, the captured toner particles had turned into an adhesive layer.

One skilled in the art will appreciate that a tray 72 need not be employed, if developer housing 40 is made from a material which is resistant to the plasticizer. Tray 72 is required only when the material of developer housing 40 is not resistant to the plasticizer. Furthermore, one skilled in the art will recognize that the adhesive layer need not be employed. The plasticizer swollen base can start capturing toner particles without a thin adhesive layer thereon.

In recapitulation, it is clear that the apparatus of the present invention seals the housing to prevent the escape of toner particles therefrom by capturing toner particles on a base material swollen with a plasticizer. The plasticizer within the base material diffuses into the toner particles causing the toner particles to soften and fuse thereto. These softened toner particles now become tacky, and act as an adhesive layer to secure additional toner particles thereto. The foregoing process continues until the quantity of plasticizer within the base material is depleted beneath a critical level.

It is, therefore, apparent that there has been provided, in accordance with the present invention, a seal which fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the claims.

I claim:

1. An apparatus for sealing a housing to prevent the escape of toner particles therefrom, including:

a region of the housing adapted to be sealed; and means, disposed on said region, for capturing the toner particles, said capturing means securing the toner particles and inducing the toner particles to soften and become tacky so that other toner particles stick to the tacky toner particles.

2. An apparatus according to claim 1, wherein said capturing means includes:

a polymer matrix base layer; and a plasticizer disposed in said base layer, said plasticizer diffusing into the toner particles to fuse thereto and become tacky for securing other toner particles thereto.

3. An apparatus according to claim 2, wherein said capturing means includes a layer of adhesive on said base layer for securing toner particles thereto.

4. An apparatus according to claim 2, wherein said plasticizer has a low vapor pressure so as to diffuse into a soluble material.

5. An apparatus according to claim 4, wherein said base layer is made from a polyvinylchloride layer.

6. An apparatus according to claim 4, wherein said base layer is made from a polymethyl methacrylate.

7. An apparatus according to claim 4, wherein said base layer is made from a polystyrene.

8. An apparatus according to claim 4, wherein said plasticizer is made from a dibutyl phthalate.

9. An apparatus according to claim 4, wherein said plasticizer is made from a methyl phthalyl ethyl glycolate.

10. An apparatus according to claim 4, wherein said plasticizer is made from a butyl phthalyl ethyl glycolate.

11. An apparatus according to claim 4, wherein said plasticizer is made from a butyl benzyl phthalate.

12. An apparatus according to claim 4, wherein said plasticizer is made from a n-octyl-n-decyl phthalate.

13. An apparatus according to claim 4, wherein said plasticizer is made from a dioctyl phthalate.

14. An apparatus according to claim 4, wherein said plasticizer is made from a di butoxy ethyl adipate.

15. An apparatus according to claim 4, wherein said plasticizer is a mixture and a plurality of different plasticizers.

16. An apparatus according to claim 4, wherein said base layer having said plasticizer disposed therein ranges from about 0.020 inches to about 0.040 inches in thickness.

17. An apparatus according to claim 3, wherein said adhesive is electrically conductive.

18. An apparatus according to claim 17, wherein said adhesive is an acrylate based adhesive.

19. An apparatus according to claim 17, wherein said adhesive is an elastomer based adhesive.

20. An apparatus according to claim 17, wherein said adhesive includes a quarternary salt.

21. An apparatus according to claim 17, further including means for electrically biasing said adhesive.

22. An apparatus according to claim 17, further including means for electrically grounding said adhesive.

23. An apparatus according to claim 3, wherein said base layer is electrically conductive.

24. An apparatus according to claim 23, further including means for electrically biasing said base layer.

25. An apparatus according to claim 23, further including means for electrically grounding said base layer.

26. An apparatus according to claim 3, further including a member mounted on said region and having said capturing means disposed therein.

27. An apparatus of the type having means for depositing toner particles on an electrostatic latent image recorded on a photoconductive member in an electrophotographic printing machine, wherein the improvement includes:

an enclosure having the depositing means disposed therein; and means, disposed in said enclosure, for capturing the toner particles, said capturing means securing the toner particles and inducing the toner particles to soften and become tacky so that other toner particles stick to the tacky toner particles.

28. An apparatus according to claim 27, wherein said capturing means includes:

a polymer matrix base layer; and a plasticizer disposed in said base layer, said plasticizer diffusing into the toner particles to fuse thereto and become tacky for securing other toner particles thereto.

29. An apparatus according to claim 28, wherein said capturing means includes a layer of adhesive on said base layer for securing toner particles thereto.

30. An apparatus according to claim 28, wherein said plasticizer has a low vapor pressure.

31. An apparatus according to claim 30, wherein said base layer is made from a polyvinylchloride layer.

32. An apparatus according to claim 30, wherein said base layer is made from a polymethyl methacrylate.

33. An apparatus according to claim 30, wherein said plasticizer is made from a polystyrene.

34. An apparatus according to claim 30, wherein said plasticizer is made from a dibutyl phthalate.

35. An apparatus according to claim 30, wherein said plasticizer is made from a methyl phthalyl ethyl glycolate.

36. An apparatus according to claim 30, wherein said plasticizer is made from a butyl phthalyl ethyl glycolate.

37. An apparatus according to claim 30, wherein said plasticizer is made from a butyl benzyl phthalate.

38. An apparatus according to claim 30, wherein said plasticizer is made from a n-octyl-n-decyl phthalate.

39. An apparatus according to claim 30, wherein said plasticizer is made from a dioctyl phthalate.

40. An apparatus according to claim 30, wherein said plasticizer is made from a di butoxy ethyl adipate.

41. An apparatus according to claim 30, wherein said base layer having said plasticizer disposed therein ranges from about 0.020 inches to about 0.040 inches in thickness.

42. An apparatus according to claim 30, wherein said adhesive is electrically conductive.

43. An apparatus according to claim 42, wherein said adhesive is an acrylate based adhesive.

44. An apparatus according to claim 42, wherein said adhesive is an elastomer based adhesive.

45. An apparatus according to claim 42, wherein said adhesive includes a quarternary salt.

46. A method of preventing the escape of toner particles from a housing, including the steps of:

adhesively securing toner particles to a crosslinked polymer matrix having a plasticizer therein; and diffusing the plasticizer into the toner particles adhesively secured to the polymer matrix to induce the toner particles to soften and become tacky so that other toner particles are secured to the tacky toner particles.

* * * * *